US005971389A

United States Patent [19]

Golicz et al.

[11] Patent Number: 5,971,389

[45] Date of Patent: Oct. 26, 1999

[54] FEEDER FOR FLAT ARTICLES OF VARYING THICKNESS

[75] Inventors: Roman M. Golicz, Clinton; Stefan G. Golicz, Essex, both of Conn.

[73] Assignee: Documotion, Inc., Old Saybrook, Conn.

[21] Appl. No.: 08/831,356

[22] Filed: Apr. 1, 1997

Related U.S. Application Data

[60] Provisional application No. 60/014,523, Apr. 1, 1996, and provisional application No. 60/018,567, May 29, 1996.

[51] Int. Cl.[6] ..... B65H 3/04

[52] U.S. Cl. ..... 271/34; 271/122; 271/124

[58] Field of Search ..... 271/34, 35, 124, 271/122, 137, 104

[56] References Cited

U.S. PATENT DOCUMENTS

| | | | |
|---|---|---|---|
| 3,995,952 | 12/1976 | Schoppe | 271/122 X |
| 4,772,004 | 9/1988 | Golicz | 271/3.1 |
| 4,844,435 | 7/1989 | Giannetti et al. | 271/10 |
| 4,909,499 | 3/1990 | O'Brien et al. | 270/10 |
| 5,033,729 | 7/1991 | Struthers | 271/10 |
| 5,062,600 | 11/1991 | Holbrook et al. | 271/35 |
| 5,335,899 | 8/1994 | Golicz | 271/34 |
| 5,342,036 | 8/1994 | Golicz | 271/3.1 |

FOREIGN PATENT DOCUMENTS

| | | | |
|---|---|---|---|
| 57-62125 | 4/1982 | Japan | 271/34 |
| 61-51433 | 3/1986 | Japan | 271/34 |

*Primary Examiner*—David H. Bollinger
*Attorney, Agent, or Firm*—C. G. Nessler

[57] ABSTRACT

A singulator adapted for feeding articles of varying thickness is comprised of a driver with a movable and resiliently biased retarder, called a dancer. The dancer moves back and forth along the article flow path, in response to the passage through the nip of the articles being singulated, to automatically set the gap at the singulator nip. A dancer body motion may be linear or pivoting. The path of article travel through the singulator nip is at an angle to the downstream article flow path. Thus, when a takeaway device pulls on the article, the dancer moves to open the singulator gap slightly to enable the article to more freely be taken away. A preferred dancer has an endless belt and is spring biased to lightly contact the driver at the nip in the absence of an article; and, periodic reversal of driver direction engages the dancer belt surface at the nip and moves it upstream, thereby exposing a new surface. A takeaway device comprises a friction roller directly driven by a motor, where the combination has a particularly low moment of inertia. Thus, when the roller engages a slow moving article issuing from an upstream device, motor rotational speed of the combination sharply decreases, to avoid damage to the article surfaces.

20 Claims, 4 Drawing Sheets

FEEDER FOR FLAT ARTICLES OF VARYING THICKNESS

This application claims benefit of Provisional Applications Ser. No. 60/014,523 filed Apr. 1, 1996, and Ser. No. 60/018,567 filed May 29, 1996.

TECHNICAL FIELD

The present invention relates to machines for feeding sheets and other more or less flat articles.

BACKGROUND

Despite the great amount of engineering attention given in the past to the problem of high speed feeding or sheets and other more or less flat articles, there is a continuing need for improved machines to overcome deficiencies which limit continuous, error free, high speed feeding. In particular, improvements are needed in reliably singulating sheets and other articles which vary in thickness or character, and for singulating them in a manner which does not adversely affect their surface character.

When singulating paper sheets and other articles using typical prior art technology, for example—feed rollers in combination with retarder rollers or belts, double feeding or other problems such as blocking or curling can occur. One contribution to problems in even carefully configured equipment is that there is variation in the characteristics of articles being fed, even when they are of the same supposed character. Too frequently, operator intervention is required to adjust machines during operation. Similarly, extensive and careful set up is often required when changing a machine from processing one type article to another. Articles which have in the past caused feeding problems include articles having step change in thickness or varied surface texture, such as envelopes with flaps fed first, articles with body joints, window envelopes, plastic credit cards affixed to paper sheets, and heavily coated or printed articles, etc.

Another area where improvement is needed is in the retarders of singulators. Retarders wear if made of elastomer or plastic, or scrape unacceptable amounts of material from the sheet surfaces if made of abrasive ceramic. They tend to loose their effectiveness when debris, such as toner from photocopied pages, accretes on their operational surfaces. Thus, there is a need for conveniently and automatically presenting clean retard surfaces at singulator nips. Still another deficiency is that when sheets are taken away from a singulator at an increased speed, there is a tendency for slipping and rubbing on the surface of articles, either at the take-away rollers or the singulator feed rollers.

SUMMARY

An object of the invention is to singulate sheets and other articles which vary in thickness using simple and low cost mechanisms. Another object of the invention is to conveniently and automatically renew retarder surfaces. Still another object of the invention is to minimize smearing or abrasion of an article surface when a takeaway device seeks to pull away the article at higher speed than dictated by its continued engagement with an upstream device such as a singulator.

In accord with the invention, a movable retarder, called a dancer, forms a singulator nip in combination with a driver such as a feed roller. At rest, the dancer is resiliently biased to be positioned close to, or in very light contact with, the driver. When a sheet or other flat article passes through the nip, the dancer, or a portion thereof, moves downstream to a degree sufficient to enable the article to pass through the nip, while retarding any other articles. Thus, the gap in the singulator nip is automatically changed, according to the thickness of the article passing through, as the retarder dances back and forth. In the preferred mode, the dancer motion is linear, and the dancer is used with a device, called a prompter, which serves both as driver at the nip and the means for bringing articles to the nip.

In a preferred embodiment, a dancer is mounted and spring biased for linear translation parallel to the article flow path. It is comprised of an endless belt stretched around high friction rollers mounted at each end of a dancer body. The spring biases the dancer very lightly into contact with the driver, in absence of a sheet in the nip. So, when the driver direction is reversed, the driver engages the otherwise stationary dancer belt and causes it to move around the dancer. Thus, a renewed belt surface is brought to the vicinity of the nip.

In further accord with the invention, the driver and dancer of a singulator are positioned relative to each other and the downstream flow path, in a way which provides a desired angled path of article travel through the nip, relative to the downstream flow path. For example, the path runs 5–30 degrees upwardly from the horizontal direction of dancer motion and flow path. Thus, as an article passing through the singulator becomes engaged by a higher speed downstream takeaway device, the article frictionally pulls the dancer slightly away from the driver, opening the gap at the nip, to the necessary takeaway force is reduced and there is no smearing of the sheet surface.

In another embodiment, a dancer is pivotably mounted at one end, so it pivots with a component of the free end motion parallel to the downstream flow path direction, as is the case with the linear motion dancer. In the preferred pivoting embodiment, a dancer is comprised of an endless belt that runs around one-way rollers at either end of the dancer body. Each time an article passing through the nip causes the dancer to pivot, the belt is automatically moved slightly, to thereby continuously renew the belt where it is close to the driver.

In accord with another aspect of the invention, a retarder is comprised of a belt running around rollers that only enable the belt to move opposite to the direction of article flow path at the nip. Periodic tensioning and relaxing of the belt between the rollers, as by a plunger, causes the belt to incrementally move and providing a new belt surface at the nip.

In another aspect of the invention, a high speed takeaway device for a singulator or other upstream device is comprised of a motor and roller system having a very low polar moment of inertia. When the takeaway device roller frictionally engages an article which is moving at a low linear speed because it is still engaged with an upstream device, the motor and roller sharply and substantially reduce rotary speed to correspond with the low linear speed, resulting in trivial slippage between the takeaway roller and the article.

The foregoing and other objects, features and advantages of the invention will become more apparent from the following description of the best mode of the invention and accompanying drawings.

DESCRIPTION

The devices described herein are suited for use with flat article feeding apparatus of the kind generally known in the art. While the invention herein is described in terms of feeding sheets of paper, it will be understood that in the generality of the invention, reference to sheets will embrace other generally flat objects, such as envelopes, sets of sheets, folded pieces, plastic things, and other articles having varied thickness and surface textures.

In a typical sheet feeder, sheets are fed from a shingled stream or a stack to a singulator or other document processing device. A singulator separates sheets into spaced apart individuals, or in some instances, provides a stream of partially overlapping sheets. The invention is particularly useful in complex high speed equipment for stuffing envelopes, for example, in the apparatus described in patent application Ser. No. 08/734,632 entitled "High Speed Envelope Packing Apparatus", by R. Golicz, an inventor here, and R. Ruggiero, the disclosure of which is hereby incorporated by reference.

Figure 1:
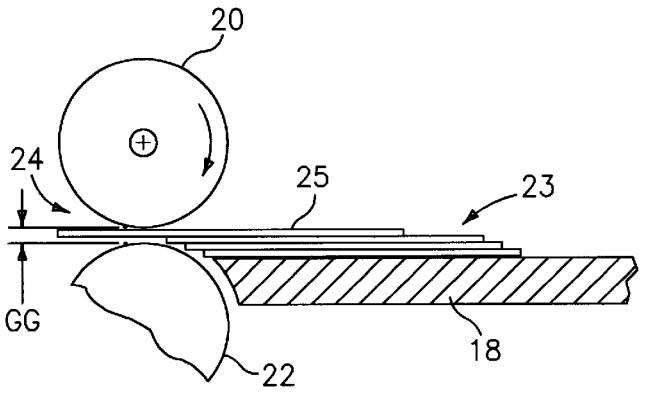
FIG. 1 (PRIOR ART)
FIG. 1 illustrates the typical essential components of a prior art singulator.

In the conventional prior art singulator, illustrated in FIG. 1, a supply of stacked sheets 23 on a conveyor 18 is passed through the singulator nip 24 formed by rotating feed roller 20 (generically referred to as a driver herein) which is spaced apart a gap distance GG from retarder 22, which may be a static roller or other structure. The gap opening GG is typically set at 100–150% of the supposed thickness of the sheets being fed. Thus, typical top sheet 25 passes through the nip, while the next underlying sheet hits the retarder and is blocked. Static and moving endless belts mounted on pulleys have been used as retarders. See for instance U.S. Pat. No. 4,909,499 of O'Brien et al. and U.S. Pat. No. 4,844,435 of Giannetti et al., the disclosures of which are hereby incorporated by reference.

The invention herein is described in preferred use with a device called a prompter. Prompters are described in more detail in co-pending PCT Application Serial No. (Attorney No. 9534), filed with the RO/US on even date hereof by the present applicants, the disclosure of which is hereby incorporated by reference.

Figure 9:
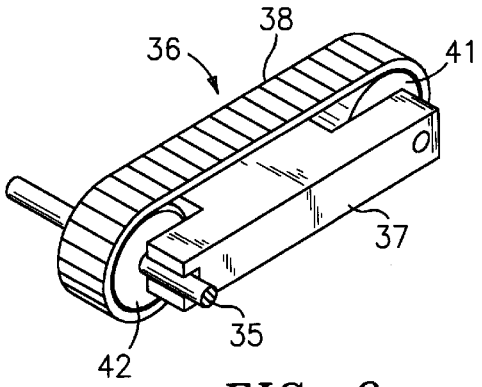
FIG. 9 is a perspective view of a prompter.

A prompter preferably brings sheets to a singulator and may form part of the singulator as well. In brief, as shown in FIG. 9, the preferred prompter 36 comprises an endless belt 38 running between two spaced apart rollers 42, 41, where first end roller 42 is mounted on a shaft 35 by which it is driven. The second roller 41 is at the prompter free end. The prompter H-shape body 37 pivotably mounts on the shaft by means of friction-inducing concave cut-out journals at the bifurcated legs of the end of the body. Both the engagement of the body with the rotating shaft and the dynamics of interaction of the belt with sheets being fed urge the prompter to pivot about the shaft, so the prompter free end engages sheets at various elevations on an infeed table. Prompter belts preferably have transverse ribbing. In the following description, ordinary feed rollers may be substituted for the prompter as a singulator driver, to the extent a portion of a prompter fulfills a feed roller function.

Figure 2:
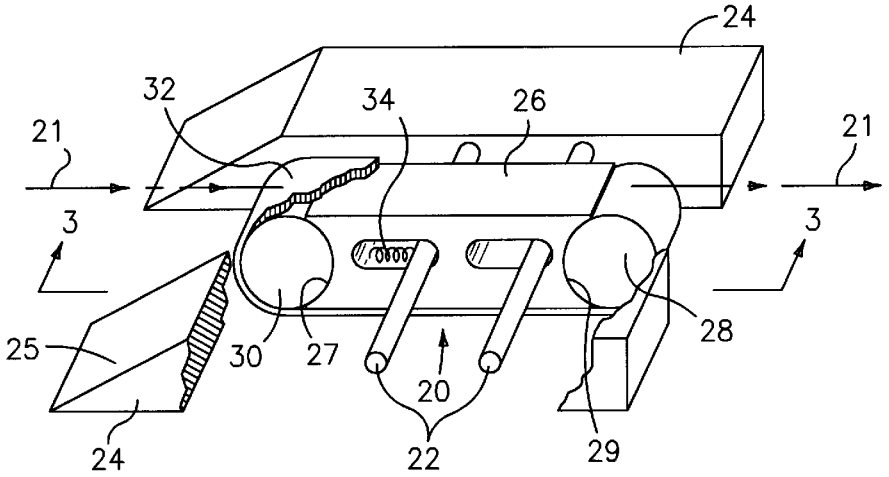
FIG. 2 is a perspective view of a retarder called a dancer and its mounting.
Figure 3:
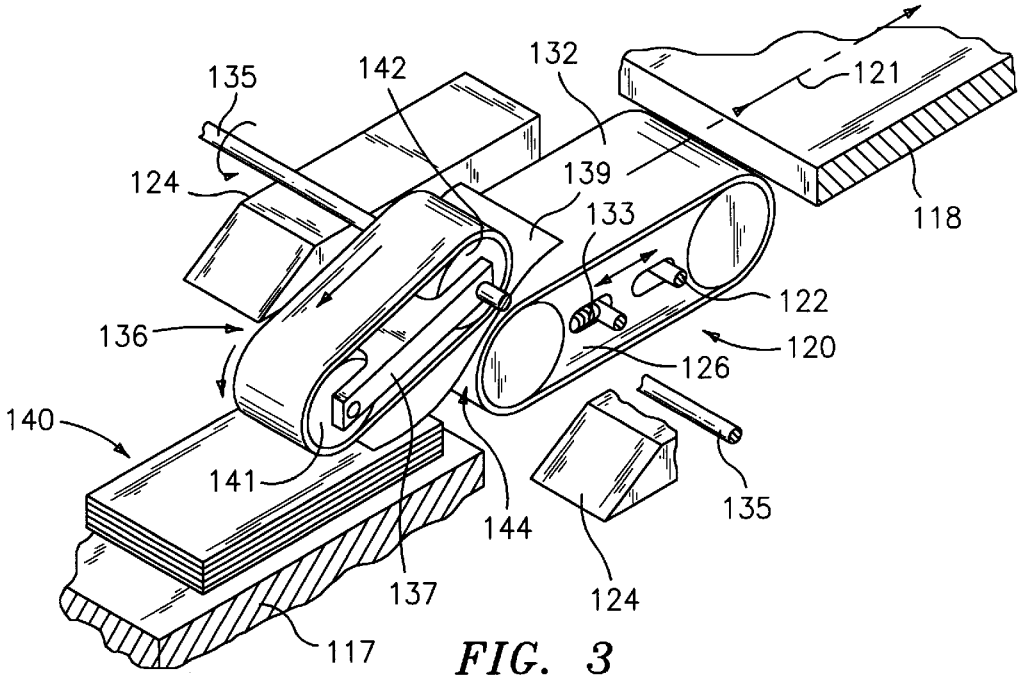
FIG. 3 is a side view of the dancer mechanism of FIG. 2 in combination with a belted singulator driver, called a prompter, as sheets are being fed.

A preferred retarder 20, called a dancer herein, is shown in perspective in FIG. 2. In FIG. 3 it is shown in combination with a prompter 36, as it forms a singulator through which sheets are being passed. The dancer 20 is linearly movable lengthwise, back and forth along the sheet flow path 21 downstream of the singulator nip 44, when it interacts with sheets which pass through the nip. A built in spring biases the dancer in the upstream direction, against the direction of sheet flow, so in the rest position, the dancer is less than one sheet thickness away from, or in light contact with, the prompter.

The dancer of FIG. 2 comprises a slotted lightweight plastic body 26 mounted on spaced apart rods 22 which are fixedly attached to spaced apart guide blocks 24. The surfaces of the guide blocks function in the same manner as does outfeed table 18, while the upstream faces 25 of the blocks are sloped to guide sheets to the singulating nip 44. The sloped faces 25 enable the infeed table 17 to be set at a lower elevation than the dancer top, as shown; and, with the prompter enable a varying amount of sheets to be in stack 40, avoiding possible problems relating to inconstant delivery of sheets to the infeed table.

Each rod 22 passes through a slot 33 in the dancer body 26. Captured within the upstream slot is compression spring 34, pressing on the body and rod 22. At opposing first and second ends of the body are semi-circular concavities 27 and 29, into which fit opposing plastic rollers 30, 28. An endless, flat, elastomer belt 32 is stretched around the rollers and the body, so it is about 3% elongated, to retain the rollers 28, 30 in place. The belt has a surface suited to frictionally engages the sheets being processed, for example 30–60 Durometer polyurethane, in accord with the prior art for retarders. Due to the tension in the belt and the friction of the rollers in their concave end journals, the rollers do not move freely, and the belt remains stationary during the feeding of sheets through the nip.

FIGS. 3 and 9 show the prompter is comprised of body 37, and opposing end rollers 41, 42, over which is stretched belt 38. Roller 42, which preferably does not have an integral one-way clutch like some prompters, is driven by rotation of shaft 35, thus moving the belt, as indicated by the arrows. The prompter belt at roller 42 cooperates as a driver with the retarder to form the singulator nip 44. The prompter belt motion at roller 41 and along the underside of the body 37 brings sheets to the nip from stack 40.

The spring 34 has a spring constant of in the range 215–285 gm/cm (about 1.2–1.4 lb/in), preferably about 250 gm/cm (about 1.4 lb/inch), and applies relatively modest force to the body. Thus, the body is easily moved by finger touch. The retarder is preferably positioned vertically and horizontally so that when the spring moves it horizontally, the retarder hits the prompter, as elaborated on below. The spring bias force is sufficiently slight that any wear between the prompter belt and retarder belt is trivial. Alternately, a stop may be used to limit the degree of horizontal bias of the retarder, so it is very close to, but not touching the driver (prompter), e.g., with a singulator gap spacing of 100 percent or less of the thickness of the anticipated thinnest article to be processed.

FIG. 3 shows how top sheet 39 is caused by the prompter belt to pass through the nip 44. As the sheet does so, the retarder 20 is thrust slightly downstream (to the right in the Figure) against the bias of spring 34, thus opening up the gap at the nip, which is otherwise too thin for the sheet. The spring bias force is chosen to be sufficient to keep the retarder from moving downstream excessively, so the desired gaging or singulating action takes place. Thus, the retarder blocks any underlying sheet which is dragged to the nip from passing through. It is seen that the gap is automatically set precisely, according to the thickness of the sheet passing through the nip.

The retarder dances back and forth according to whether a sheet is in the nip or not, and according to what the sheet thickness is. Thus, we refer to this style retarder as a "dancer". Another advantage to the dancer will be appreciated from discussion below about the angle at which sheets pass through the singulator, compared to the movement direction of the dancer.

Figure 4:
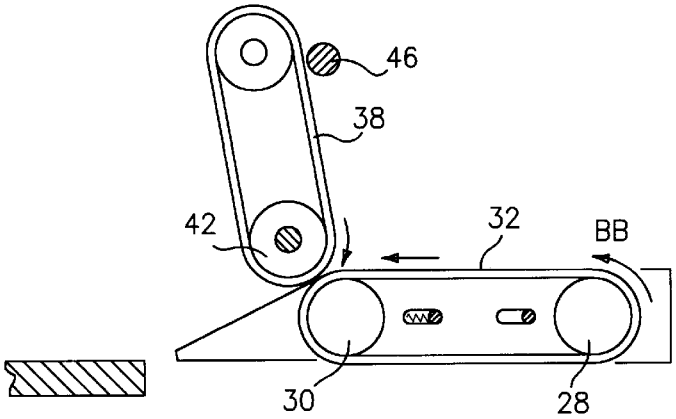
FIG. 4 is a schematic view similar to what is shown in FIG. 3, showing how, when the prompter drive direction is reversed the retarder belt is moved.

The surface of the dancer belt 32, as with other retarders, is prone to wear and accretion of debris. When the dancer is positioned so it contacts the driver in the absence of a sheet in the nip, the position of the dancer belt may be changed by periodically reversing the direction of the driver. As shown by FIG. 4, reversal of rotation of roller 42 causes the prompter-driver to pivot upwardly until it hits an optional idler pulley stop 46. Continued rotation further engages the prompter belt 38 with the dancer belt 32, as the dancer is pulled upstream. Then, the resistence of dancer belt 32 to motion is overcome, and the top surface of the dancer belt is moved upstream as indicated by arrow BB, by an amount determined by the time of reversal. Alternately, stop 46 may be eliminated, and the prompter will flop over on top of the retarder belt 32, to accomplish the same result.

Figure 5:
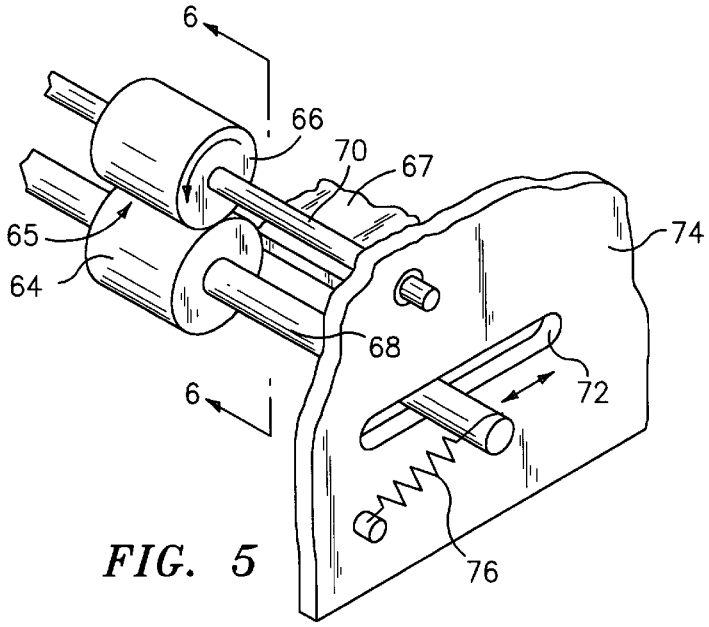
FIG. 5 shows in fragmentary perspective another embodiment of dancer.

The perspective view of FIG. 5 illustrates another embodiment of the invention where the dancer comprises a non-rotatable retard roller 64 fastened to shaft 68. Shaft 68 mounts at either end in typical horizontal slot 72 in the apparatus sidewall 74. Typical tension spring 76 biases the shaft, and thus the dancer upstream. The dancer cooperates with rotating drive roller 66 to form a singulator nip 65.

Figure 6:
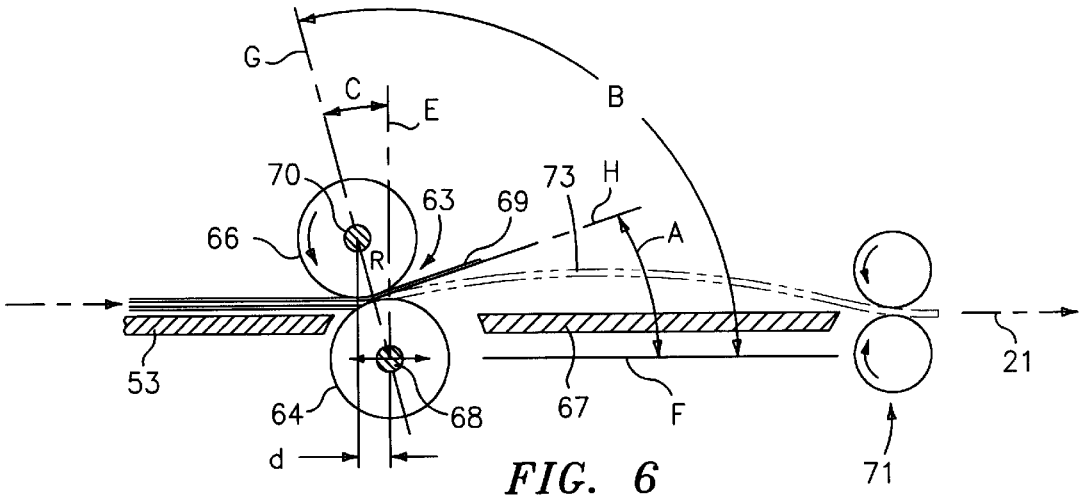
FIG. 6 is a side view of portions mechanism of FIG. 5, with feed tables, to illustrate the geometric relations between the components.

FIG. 6 shows the same driver and dancer as in FIG. 5, with infeed and outfeed tables 53, 67; and, it shows how sheets pass through the nip, moving the dancer downstream. FIG. 6 also illustrates geometric relationships generally applicable to dancers, including dancer 26 in FIG. 2. They are important when sheets are being taken away from the singulator by a downstream device faster than dictated by the feed roller 66.

FIG. 6 shows feed roller 66 and dancer 64 are vertically spaced apart so the dancer interferes with the roller, or a sheet in the nip at the roller, when the dancer moves horizontally along its travel path F. Upon interference contact with the roller, or any sheet in the nip, the dancer centerline is a horizontal distance d downstream of the roller plumb line. Accordingly, Line G, which connects the centers of feed roller and retarder, slopes upstream at angle C with respect to the vertical axis E. Radius R of feed roller 66 runs along the line G, as it is that radius which which is perpendicular to the tangent of the feed roller, which tangent is parallel to the surface of typical sheet 69 when it is in the nip. (This principle will apply when the retarder is non-circular.) More generally, the line G and radius R are at an angle B of greater than 90 degrees to dancer travel path F, typically about 15–30 degrees. The foregoing geometries cause typical sheet 69, as it passes through the singulator, to run upwardly along a line of travel H, which has an angle A to path F. Angle A is nominally equal to angle C.

Thus, in the generality of the invention, the sheet moves along a horizontal flow path 21 downstream of the singulator. The overall sheet flow path is generally horizontal, but for the local deviation for transit through the nip 63. As typical sheet 69 passes through the singulator nip it moves along a travel path which is angled upwardly from the generally horizontal flow path. As the sheet moves out of the nip, it bends over from its diverging local path and back down to the elevation of outfeed table 67, to engage takeaway rollers 71, as illustrated by the phantom sheet 73. The takeway rollers 71 pull the sheet again along the essential horizontal flow path and, thus, generally parallel to the horizontal line F of dancer translation. Corollaries to the foregoing are: The takeaway direction is at an angle to the tangent to the sheet surface in the nip; and, the dancer travel path is at an angle to the tangent to the sheet surface in the nip. It will be appreciated that in other embodiments, the same essential geometric relations will obtain if the dancer is sloped or vertical in space.

When the foregoing geometry obtains, and the takeaway device pulls on the sheet, the dancer will move downstream against the spring bias, desirably lessening the frictional engagement in the nip due to interaction of the roller and the dancer. Thus, sheets are less prone to smearing or wear.

It will be appreciated that dancers are also usable even when the geometry is not as stated for FIG. 6. Thus, a feed roller may alternately be positioned along a plumb line directly above the dancer, with upstream dancer travel limited by a stop; and with the nip gap between the dancer and feed roller being less than the thickness of anticipated sheets.

Figure 7:
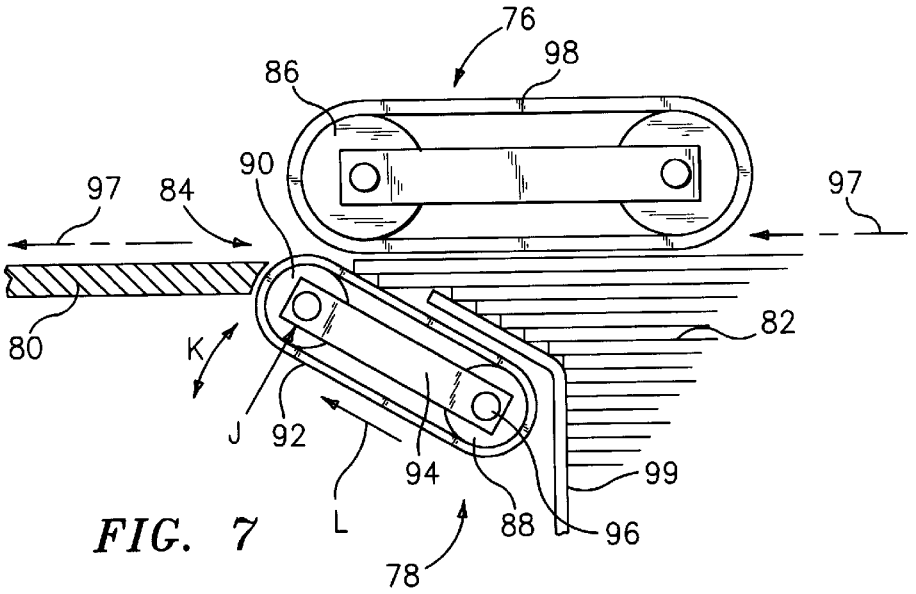
FIG. 7 is a side view of a singulator comprised of a prompter in combination with a pivotable retarder.

FIG. 7 shows still another embodiment, dancer 78 which moves during sheet feeding with a rotatable motion. Prompter 76, constructed like previously described prompter 36, acts as a combination feeder and singulator driver, as previously described for FIG. 3. The stack 82 is fed upwardly by an unshown elevator, as sheets are removed from the top of the stack. In this embodiment, as sheets are drawn through the nip 84 from a stack 82, the motion of the dancer continuously and automatically changes the portion of the belt presented at the singulator nip 84.

Preferably, dancer 78 is constructed similarly to prompter 76, as shown in FIG. 7. The dancer comprises a body 94, on which are mounted opposing end rollers 88, 90. Both rollers, and at least roller 88, have integral one-way clutches. A belt 92 is stretched around the rollers. It mates with prompter belt 98 to form the nip 84 at roller 90. The body is pivotably mounted at one end on fixed shaft 96, and biased to rotate toward the prompter by a resilient force represented by the vector J, so the dancer belt touches or nearly touches the prompter belt 98. The force J may be provided by a variety of means, for example, by a torsion spring mounted around shaft 96. Shield 99 prevents all but the uppermost of the sheets of stack 82 from contacting the dancer and interfering with its dancing motion.

In operation, when a sheet passes through the nip to output table 80, the dancer is rotated slightly away from the prompter, and then back, as indicated by the arrow K. When the body 94 pivots to open the nip, the one-way clutch prevents corresponding rotation of roller 88, and thus the belt moves relative to the body, as indicated by the arrow L. When the body swings back to its rest position the belt motion is preserved by action of the one-way clutch, again, and the belt advances an increment.

Because of the geometry shown in the FIG. 7, when the dancer 78 pivots, the end at roller 90 which forms the nip has a horizontal component of motion. That translational component is thus parallel to the general flow path 97 of the sheet, which is a common feature the pivoting dancer has with the linear motion dancers previously described. In the generality of the FIG. 7 invention, the dancer may be a monolithic member having a suitable friction surface.

Figure 8:
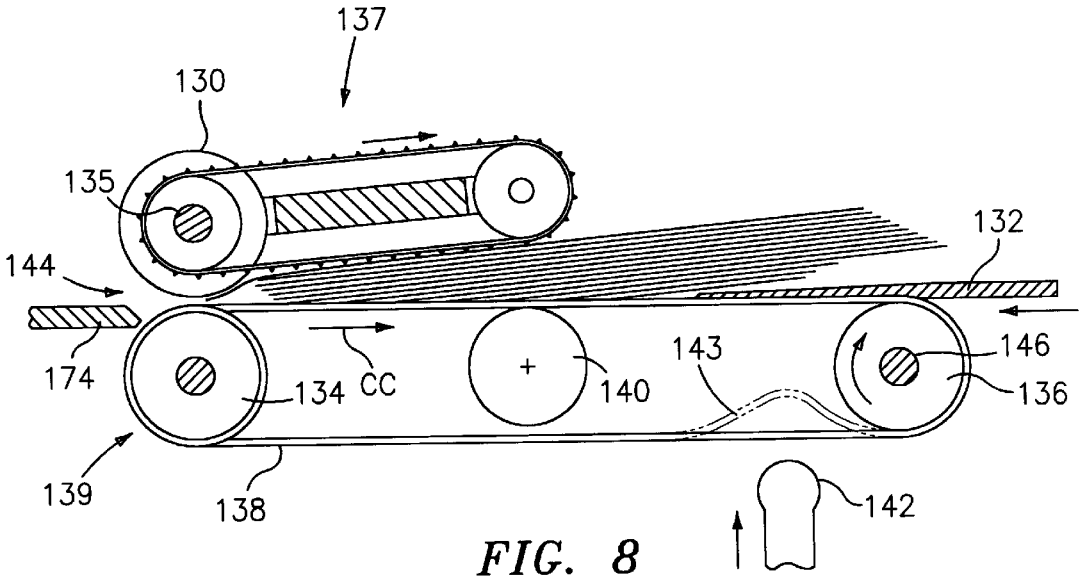
FIG. 8 is a side view of a singulator comprised of a retarder comprised of a upwardly sloped belt which is incrementally movable.

FIG. 8 shows another useful but non-dancing retarder in combination with a prompter 137 which is co-mounted on shaft 135 with singulating feed roller 130. The prompter is like that previously described for FIG. 2. In this embodiment, the prompter delivers sheets to the singulating nip 144 but it per se is not part of the singulator. The retarder 139 is comprised of an elastomeric retard belt 138, such as one made of 60–75 Durometer polyurethane, mounted on rollers 134, 136. Both rollers are mounted on static shafts. At least roller 136, and preferably both rollers, comprise integral one-way roller clutches. Thus, the top part of the retard belt can only be driven in the upstream direction, indicated by arrow CC.

The upstream retard roller 136 is somewhat lower in elevation than roller 134. Thus, the upstream surface of belt 138 is lower than the surface of infeed table 132. At the downstream end of the retard assembly, the belt rises above the table surface to the desired elevation, for a proper singulating nip with feed roller 130. This feature enables a longer length (and longer life) retard belt. It avoids inhibiting sheet motion toward the singulator, as would result if the belt ran along the infeed table surface.

As sheets pass over the retard belt proximate the singulator nip 144, there is a normal tendency for wear and accretion of debris on the belt. A renewed belt surface at the nip is achieved by programmed periodic action of plunger 142. The plunger presses vertically against the underside of the belt, tensioning, stretching and then relaxing it, as suggested by the stretched belt 143, shown in phantom. See FIG. 8. On tensioning, the belt moves and slightly rotates roller 136 about shaft 146, while roller 134 cannot move in reverse. On relaxation, the belt slightly rotates roller 134 while roller 136 remains stationary; whereupon, the top portion of the belt moves a small distance in the upstream direction and a new part of the belt surface is exposed proximate the singulator feed roller 130. The end of the plunger 142 which contacts the belt preferably is made of an abrasive stone, so that when the belt is tensioned and relaxed there will be a scraping of the belt surface, to thereby remove any accreted debris. Alternately, the belt may be tensioned and relaxed by other means than the plunger, for instance by a pin which pulls it outwardly.

Still another aspect of the invention relates to how sheets are taken away, across the outfeed table, at a second speed, faster the first speed at which they are delivered to the outfeed table, to thereby increase their spacing. To avoid smearing or abrasion of the sheet, prior art devices attempt to limit the force of a takeaway roller on the sheet by using either (a) a constant speed metal roller which slips by design on the paper surfce or (b) a high friction roller driven by a constant speed motor through a slip clutch.

Figure 10:
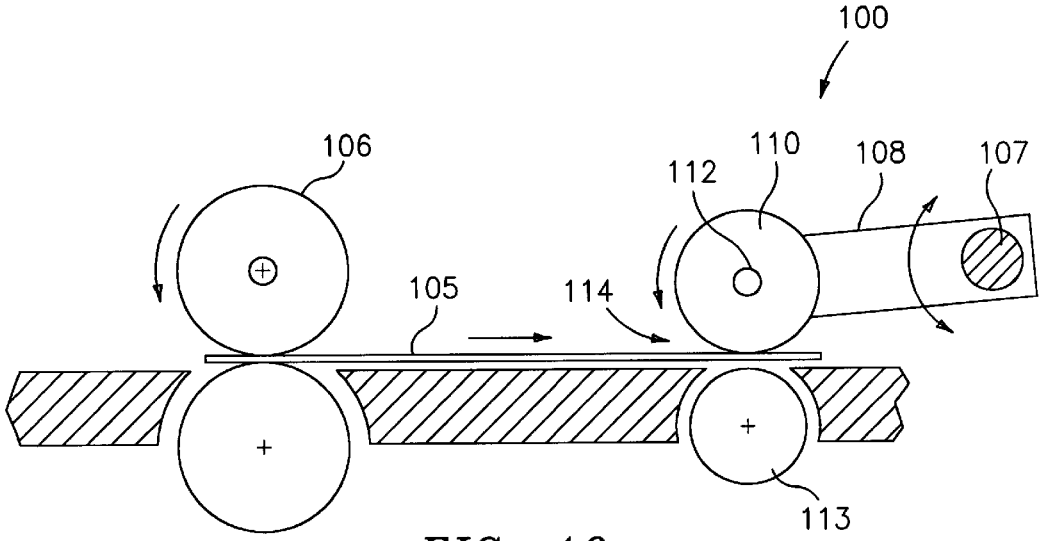
FIG. 10 shows in elevation view a takeaway mechanism which employs a low moment of inertia motor and roller assembly.
Figure 11:
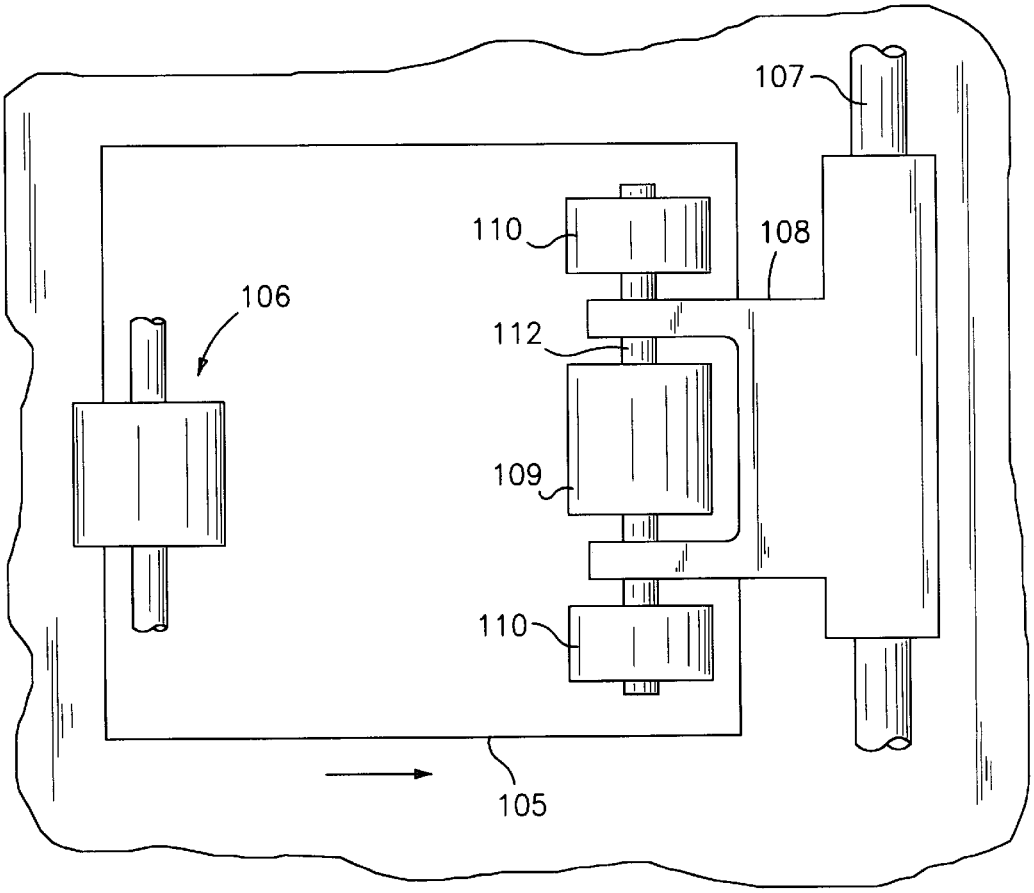
FIG. 11 is a top view of the mechanism shown in FIG. 10.

In the invention, as illustrated by side view FIG. 10 and top view FIG. 11, a sheet 105 passing through a singulator 106 is acted on by the takeaway device 100 comprised of high friction drive roller 110 and idler roller 113. Dual rollers 110, fabricated with lightweight material and construction, and mounted on motor shaft 112 are directly driven by motor 109. The rollers and motor are attached to bracket 108 which is pivotably mounted on support shaft 107. Suitable weights, springs or counterbalances are used to obtain a desired downward force on the sheet at the takeaway nip 114.

Rollers 110 have a high friction surface, such as provided by 35–40 Durometer natural rubber with a coefficient of friction with paper in the range 1.8–2.2, to engage sheets. Motor 109 is specially chosen for low moment of inertia and torque control character. For example, Pittman 8322G321-R1 direct current electric motor (Penn Engineering and Manufacturing Corp., Harleysville, Pa., USA) is useful. The power to the motor is set to impart to the rollers 110 a torque which is insufficient to break loose the rollers when it pulls on a sheet which resists movement at higher speed because it is still engaged with the upstream singulator 106. The combination of motor and rollers 110 is chosen for a polar moment of inertia sufficiently low to enable the motor and rollers to sharply and substantially decrease rotational speed, when a slow moving sheet enters nip 114 of takeaway device 100. So, the surface speed of the roller nearly instantly corresponds with the nominal first speed of the sheet. Thus, there is negligible slippage at either the takeaway nip 114 or the singulator 106. The invention is simpler than the prior art of clutches and the like and requires no adjustment.

Although only the preferred embodiment has been described with some alternatives, it will be understood that further changes in form and detail may be made without departing from the spirit and scope of the claimed invention.

We claim:

1. Apparatus for singulating sheets and other flat articles, wherein articles move downstream along an article flow path and through a singulator nip having a gap spacing, which comprises a driver for moving articles downstream through the nip;

a retarder, called a dancer, positioned in close proximity to the driver, to form the singulator nip;

the dancer movably mounted to enable a portion thereof to translate generally along the article flow path;

means for resiliently biasing the dancer surface portion in the upstream flow path direction;

wherein, the gap spacing between the dancer surface portion and driver is changed by translation of the dancer portion in the downstream direction, when an article passes through the nip.

2. The apparatus of claim 1 wherein, when articles are absent from the nip, the gap spacing at the nip between the surface portion surfaces of the dancer and driver is essentially zero.

3. The apparatus of claim 1 wherein the driver is a device called a prompter, which prompter comprises:

a shaft, running transversely to the flow path;

a first roller, mounted on the shaft;

a body, having a first end and second end lying along the body length, the first end pivotably engaged with the shaft, the second end movably positioned upstream of the first end;

a second roller, mounted at the second end of the body;

a belt, mounted on and endlessly running around the first and second rollers, having a surface adapted to frictionally engage and move downstream articles along the flow path; and, means for moving the belt around the rollers.

4. The apparatus of claim 1 wherein the dancer comprises a belt, movable in one direction only around the exterior of a body of the dancer, for contacting articles in the nip and for contacting the driver in the absence of any article in the nip; wherein, when the direction of the driver is reversed, the driver frictionally engages said belt and causes it to move in said one direction, to thereby expose a new portion of the belt in vicinity of the nip.

5. The apparatus of claim 1 wherein upstream motion of the dancer is limited by interference contact with the driver at the nip; wherein, the means for biasing exerts a force on the dancer insufficient to cause significant wear on the dancer surface, when the dancer makes interference contact with a driver which has motion adapted to move articles.

6. The apparatus of claim 5 wherein the means for biasing comprises a spring with a spring constant of about 215 to 285 grams per centimeter (about 1.2 to 1.4 pounds per inch).

7. The apparatus of claim 1 wherein the dancer is movable linearly and articles travel through the nip along a line of travel which is at an angle to the direction in which the dancer is movable.

8. The apparatus of claim 7 further comprising a takeaway device for pulling on an article while the article is passing through the nip, wherein the takeaway devices pulls in the direction in which the dancer is movable.

9. The apparatus of claim 8 wherein said angle is 5–30 degrees, more preferably 15–30 degrees.

10. The apparatus of claim 1 wherein articles travel through the nip along a line of travel which is at an angle to the general direction of the article flow path, downstream of the singulator.

11. The apparatus of claim 1 wherein the driver moves articles through the nip at a first surface speed, further comprising: a takeaway device for removing articles from vicinity of the nip at a second surface speed which is faster than said first surface speed imparted by the driver; wherein the takeaway device engages an article while a portion thereof is still in the nip and thereby causes the dancer to translate downstream due to frictional engagement of the dancer with the article.

12. The apparatus of of claim 11 wherein the takeaway device comprises a roller coupled to a rotating motor, the roller adapted to frictionally engage said articles, the combination of motor and roller having a polar moment of inertia sufficiently low, such that, when the roller frictionally engages any one of said articles while said one is still in the nip, the rotational speed of said combination sharply and substantially decreases to thereby provide the roller with a surface speed nominally matching said article first surface speed.

13. The apparatus of claim 1 wherein the articles move generally along a horizontal plane; and wherein the dancer motion is confined within the horizontal plane.

14. The apparatus of claim 1 wherein the articles move generally along a horizontal plane; and, wherein, the dancer rotates in a vertical plane, responsive to passage of an article through the nip.

15. The apparatus of claim 14 wherein the dancer is comprised of a belt mounted on rollers, to provide a belt surface at the nip; wherein, rotation of the dancer causes incremental movement of the belt on the rollers.

16. The apparatus of claim 1 wherein the dancer comprises:

means for supporting a dancer body;

a dancer body having a length lying along the flow path and opposing ends for receiving rollers, the dancer movably mounted for linear motion on said means for supporting a dancer;

rollers pivotably mounted at opposing ends of the dancer body;

an endless belt stretched over the rollers and around the body, wherein the belt is movable around the body, wherein a portion of the surface of the belt contacts articles at the nip; and, wherein, said belt surface portion is movable around the body in the upstream direction only.

17. The apparatus of claim 16 wherein the dancer body has two spaced apart slots running transverse to the body length; wherein the means for supporting the dancer body comprises two fixed rods, one each running through each of said said slots; wherein the means for resiliently biasing comprises at least one spring captured between the body and a rod.

18. The apparatus of claim 16 wherein the driver is a prompter; and, wherein, the prompter additionally pulls articles from an upstream stack into the singulator nip.

19. Apparatus for singulating sheets and other flat articles, wherein articles move downstream along an article flow path which lies generally in a first plane, and through a singulator nip having a gap spacing; comprising:

a singulator comprised of a driver and a retarder;

the retarder, called a dancer, comprised of a body having opposing first and second body ends, pivotally mounted at a first end on a fixed shaft, to pivot in a second plane perpendicular to the first plane, so that the second end is proximate the driver, to thereby form the singulator nip with the driver;

means for resiliently biasing the body rotationally, so the second end tends toward contact with the driver; and, wherein, when an article passes through the nip, the dancer is rotated slightly in said plane, with a component of rotational motion in the downstream direction.

20. The apparatus of claim 19 further comprising:

a pair of rollers, one mounted at each of said ends of the body, at least one roller comprising a one way clutch;

a belt, running around the rollers, for frictionally engaging articles; and, wherein, when the dancer rotates due to passage of an article through the nip, the belt is caused to move on the rollers.

* * * * *

UNITED STATES PATENT AND TRADEMARK OFFICE

CERTIFICATE OF CORRECTION

PATENT NO. : 5,971,389

DATED : October 26, 1999

INVENTOR(S) : Golicz et al.

It is certified that error appears in the above-indentified patent and that said Letters Patent is hereby corrected as shown below:

Column 8, line 44, before "portion" insert --surface--

Column 8, line 54, delete "surfaces"

Signed and Sealed this

Eighteenth Day of April, 2000

*Attest:*

Q. TODD DICKINSON

*Attesting Officer*

*Director of Patents and Trademarks*